United States Patent [19]

Seiki et al.

[11] Patent Number: 4,832,867

[45] Date of Patent: May 23, 1989

[54] LUBRICATING OIL COMPOSITION

[75] Inventors: Hiromichi Seiki; Hideo Igarashi, both of Ichihara, Japan

[73] Assignee: Idemitsu Kosan Co., Ltd., Tokyo, Japan

[21] Appl. No.: 255,864

[22] Filed: Oct. 11, 1988

[30] Foreign Application Priority Data

Oct. 22, 1987 [JP] Japan ..... 62-265473
Mar. 5, 1988 [JP] Japan ..... 63-50609

[51] Int. Cl.[4] ..... C10M 105/32; C10M 105/74

[52] U.S. Cl. ..... 252/325; 257/42.7; 257/46.4; 257/46.6

[58] Field of Search ..... 252/32.5, 42.7, 32.7 E, 252/32.7 HC, 46.3, 464, 46.6

[56] References Cited

U.S. PATENT DOCUMENTS 2,363,510 11/1944 Farmington ..... 252/32.5
3,219,676 11/1965 Wilkinson ..... 252/32.5
4,776,969 10/1988 Ryer ..... 252/46.6

FOREIGN PATENT DOCUMENTS 2504115 8/1975 Fed. Rep. of Germany ..... 252/32.5
2545500 4/1976 Fed. Rep. of Germany ..... 252/32.5
1240507 4/1957 France ..... 252/32.5
0485841 8/1967 Switzerland ..... 252/32.5

*Primary Examiner*—William R. Dixon, Jr.
*Assistant Examiner*—James M. Hunter, Jr.
*Attorney, Agent, or Firm*—Frishauf, Holtz, Goodman & Woodward

[57] ABSTRACT

Lubricating oil composition which comprises: lubricating base oil, (A) at least one organophosphorus compound represented by the general formula (I), (II), (III), (IV), (V), (VI), (VII) or (VIII)

and (B) at least one organomolybdenum compound selected from the group consisting of molybdenum oxysulfide alkylphosphorodithioates and molybdenum oxysulfide alkyldithiocarbamates.

The lubricating oil composition is excellent in antiwear properties, anti-seizure properties, and corrosion resistance, and is suitable for gear oils, and bearing oils, also for internal combustion engine oils and automatic transmission fluids, and further for hydraulic fluids, metal working fluids.

3 Claims, No Drawings

LUBRICATING OIL COMPOSITION

BACKGROUND OF THE INVENTION

1. Field of the Invention

This invention relates to lubricating oil compositions. More particularly it relates to lubricating oil compositions that are excellent in antiwear properties, anti-seizure properties, and corrosion resistance, and are suitable for gear oils, and bearing oils, also for internal combustion engine oils and automatic transmission fluids, and further for hydraulic fluids, metal working fluids, and the like.

2. Description of the Related Art

Lubricating oils for various applications are generally required to have anti-seizure properties and antiwear properties for many situations. Especially, lubricating oils that require a high degree of anti-seizure property and antiwear property need incorporation of extreme pressure agents, which has resulted in increased corrosion of metals and posed a great problem in practice.

Metal deactivators have been added to lubricating oils incorporated with extreme pressure agents to solve this problems, but has given rise to a question of decreasing anti-seizure property and antiwear property as side effects.

Recently there was a proposal for preparation of lubricating oil compositions with improved anti-seizure property and antiwear property by incorporating to the base oil organomolybdenum compounds in combination with mono-, di-substituted phosphates or mono-, di-substituted phosphites (Japanese Patent Application Laid-Open No. 75995/1984).

The lubricating oil compositions described above have shown some extent of improvement in anti-seizure property and antiwear property but have still left the problem of failure in reducing metal corrosion unsolved.

SUMMARY OF THE INVENTION

An object of this invention is to provide lubricating oil compositions with improved anti-seizure properties and antiwear property. Another object of this invention is to provide lubricating oil compositions with little metal corrosion.

The present invention relates to lubricating oil composition which comprises: lubricating base oil, (A) at least one organophosphorus compound represented by the general formula (I), (II), (III), (IV), (V), (VI), (VII) or (VIII);

$$R^1R^2R^3P \qquad \text{(I)}$$

(wherein $R^1$, $R^2$ and $R^3$ are each an alkyl group having 1 to 18 carbon atoms, an aryl group having 6 to 25 carbon atoms or a cycloalkyl group having 6 to 25 carbon atoms), $$R^1R^2PPR^3R^4 \qquad \text{(II)}$$

(wherein $R^1$, $R^2$ and $R^3$ are the same as defined above, and $R^4$ *is an alkyl group having* 1 to 18 carbon atoms, and aryl group having 6 to 25 carbon atoms or a cycloalkyl group having 6 to 25 carbon atoms), $$R^1R^2P(CH_2)_nPR^3R^4 \qquad \text{(III)}$$

(wherein $R^1$, $R^2$, $R^3$ and $R^4$ are the same as defined above, and n in an integer of 1 to 4),

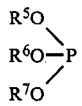

(IV)

(wherein $R^5$, $R^6$ and $R^7$ are each a hydrocarbon group having 1 to 30 carbon atoms or a halogenated hydrocarbon group having 1 to 30 carbon atoms),

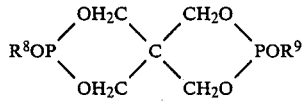

(V)

(wherein $R^8$ and $R^9$ are each a hydrocarbon group having 1 to 30 carbon atoms),

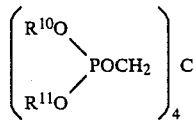

(VI)

(wherein $R^{10}$ and $R^{11}$ are each a hydrocarbon group having 1 to 30 carbon atoms),

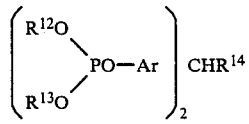

(VII)

(wherein $R^{12}$ and $R^{13}$ are each a hydrocarbon group having 1 to 30 carbon atoms, $R^{14}$ is an alkyl group having 1 to 30 carbon atoms and Ar is an arylene group having 6 to 30 carbon atoms),

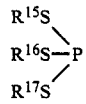

(VIII)

(wherein $R^{15}$, $R^{16}$ and $R^{17}$ are each a hydrocarbon group having 1 to 30 carbon atoms), and (B) at least one organomolybdenum compound selected from the group consisting of molybdenum oxysulfide alkylphosphorodithioates and molybdenum oxysulfide alkyldithiocarbamates.

DESCRIPTION OF PREFERRED EMBODIMENT

A lubricating base oil, the principal component of lubricating oil composition, used in this invention can be selected from a variety of mineral oils and synthetic oils without any special limitation as far as they are of a type of base oil used for conventional lubricating oils. Properties of the base oil such as kinematic viscosity, viscosity index, and pour point, may be suitably specified depending on the applications and required characteristics of the lubricating oil composition.

Mineral oils which can be used as the base oil include a distillate oil obtained by atmospheric distillation of a paraffin base crude oil, an intermediate base crude oil or a naphthene base crude oil, or by vacuum distillation of a residual oil resulting from the above atmospheric distillation and a purified oil obtained by conventional method, such as solvent-refined oil, hydrogenated oil and dewaxed oil.

Synthetic oils include polybutene, poly-α-olefin, polyglycol ether, polyphenylether, polyol ester, complex ester, alkylbenzene, alkylnaphthalene, dibasic acid ester, phosphoric acid ester, silcone oil, silicic acid ester, alkyldiphenyl and the like.

In a lubricating oil composition of this invention, an aforementioned base oil is incorporated with (A) organophosphorus compounds and (B) organomolybdenum compounds. The organophosphorus compounds, the (A) component used herein, are classified into; organophosphine compounds represented by the above general formulas (I)-(III) and organophosphite compounds represented by the above general formulas (IV)-(VIII).

Among (A) organophosphorus compounds used in this invention, organophosphine compounds are at least one type of compound from among: tri-substituted phosphines represented by general formula (I); tetra-substituted diphosphine represented by general formula (II); and bis(di-substituted phosphino)alkane represented by general formula (III). In the general formulas (I)-(III), each of $R^1$, $R^2$, $R^3$ and $R^4$ as described previously represents an alkyl group with 1-18 carbon atoms, an aryl group with 6-25 carbon atoms, or a cycloalkyl group with 6-25 carbon atoms, and n denotes an integer of 1-4.

Examples of tri-substituted phosphines represented by the above general formula (I) include trialkylphosphine such as trimethylphosphine, triethylphosphine, tri-n-propylphosphine, tri-iso-propylphosphine, tri-n-butylphosphine, tri-iso-butylphosphine, tri-n-hexylphosphine, tri-n-octylphosphine, tri-2-ethylhexylphosphine etc.; triarylphosphine such as triphenylphosphine, tri-o-tolylphosphine, tri-m-tolylphosphine, tri-p-tolyphosphine etc.; alkyl(aryl)phosphine such as dimethyl(phenyl)phosphine, methyl(diphenyl)phosphine etc.; and tricyclohexylphosphine etc. Tetra-substituted diphosphines represented by the above general formula (II) are, for example, tetraalkyldiphosphine such as tetramethyldiphosphine, tetraethyldiphosphine, tetrabutyldiphosphine, tetraoctyldiphosphine etc. and also tetraphenyldiphosphine and the like. Bis(di-substituted phosphino)alkane represented by the above general formula (III) are, for examples; bis(diarylphosphino)alkane such as bis(diphenylphosphino)methane, 1,2-bis(diphenylphosphino)ethane, 1,3-bis(diphenylphosphino)propane, 1,4-bis(diphenylphosphino)butane etc. and also bis(dibutylphosphino)methane and the like.

Among (A) organophosphorus compounds used in this invention, organophosphite compounds are at least one type of compound from among; tri-substituted phosphites represented by general formula (IV); pentaerythritol diphosphites represented by general formula (V); pentaerythritol tetraphosphite represented by general formula (VI); alkylidene-bis-phosphites represented by general formula (VII); and pentaerythritol trisubstituted thiophosphites represented by general formula (VIII). In the general formulas (IV)-(VIII), $R^5$-$R^7$ and Ar are as defined above. Tri-substituted phosphites represented by general formula (IV) may thus vary with the types of substituting groups $R^5$ -$R^{17}$ (which specifically are the same as $R^{18}$ and $R^{19}$ as described later).

As the preferable compounds, there may be mentioned trialkylphosphite such as triethylphosphite, tri(chloroethyl)phosphite, tri(dichloropropyl)phosphite, tri-n-butylphosphite, tri-iso-octylphosphite, tri-2-ethylhexylphosphite, tri-iso-decylphosphite, trilauryl-phosphite, tris(tridecyl)phosphite, tristearylphosphite, trioleylphosphite etc. or tri(halogenated alkyl)phosphite, furthermore triarylphosphite such as triphenylphosphite, tricresylphosphite, tris(cyclohexylphenyl)phosphite, tris(diphenylyl)phosphite, tris(nonylphenyl)phosphite, tris(dinonylphenyl)phosphite, tris(2,4-di-t-butylphenyl)phosphite etc. or tri(alkylaryl)phosphite, moreover monoalkyldiarylphosphite such as phenylisodecylphosphite, diphenylisooctylphosphite, diphenyldecylphosphite, diphenylisodecylphosphite, diphenyl(tridecyl)phosphite, diphenyl(nonylphenyl)phosphite, di(nonylphenyl)(dinonylphenyl)phosphite etc.

Pentaerythritol diphosphites represented by the general formula (V) have wide variation according to the meanings of $R^8$ and $R^9$ in the formula (V) (practically the same as $R^{18}$ and $R^{19}$ defined hereinafter). Among those, preferable compounds are; diisodecylpentaerythritol diphosphite, distearylpentaerythritol diphosphite, di(2,4-dit-butylphenyl)pentaerythritol diphosphite and the like.

Pentaerythritol tetraphosphites represented by the general formula (VI) have wide variation according to the meanings of $R^{10}$ and $R^{11}$ in the formula (VI) (practically the same as $R^{18}$ and $R^{19}$ defined hereinafter). Among those, for example, tetraphenyltetratridecylpentaerythritol tetraphosphite and the like are preferably employed.

Alkylidenebisphosphites represented by the general formula (VII) have wide variation according to the meanings of $R^{12}$ and $R^{13}$ in the formula (VII) (practically the same as $R^{18}$ and $R^{19}$ defined hereinafter) and $R^{14}$ (for example, methyl, ethyl, propyl and butyl radical etc.) as well as the meanings of Ar. Among those, 4,4'-butylidene- bis(3-methyl-6-t-butylphenyl-ditridecyl)phosphite and the like are preferably used.

Tri-substituted thiophosphites represented by the general formula (VIII) have wide variation according to the meanings of $R^{15}$-$R^{17}$ in the formula (practically the same as $R^{18}$ and $R^{19}$ defined hereinafter). Among those, tri-n-butyltrithiophosphite, trilauryltrithiophosphite and the like are preferred.

In this invention, the (A) component consists of a single compound or of a combination of two or more compounds selected from the organophosphorus compounds with the above general formulas (I)-(VIII). The proportion of the (A) component is not limited and can be suitably selected, according to various conditions, but preferably 0.01-5% by weight and the most preferably 0.1-2% by weight of the whole composition.

In this invention, organomolybdenum compounds as the (B) component are incorporated into the lubricating base oil together with the above (A) component.

The organic molybdenum compounds are one or more compounds selected from the group consisting of molybdenum oxysulfide alkylphosphorodithioates and molybdenum oxysulfide alkyldithiocarbamates. The molybdenum oxysulfide alkylphosphorodithioates(MoDTP) are represented by the following general formula (IX)

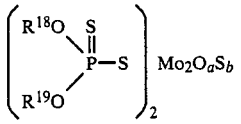

(IX)

and the molybdenum oxysulfide alkyldithiocarbamates (MoDTC) are represented by the following general formula (IX)

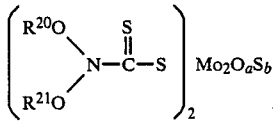

(X)

In the general formula (IX), each of $R^{18}$ and $R^{19}$ stands for a hydrocarbon radical of from 1 to 30 carbon atoms, for example, alkyl radical of from 1 to 30 carbon atoms (e.g. methyl, ethyl, n-propyl, isopropyl, n-butyl, isobutyl, secbutyl, n-amyl, isoamyl, n-hexyl, 1methylpentyl, 4-methylpentyl, 1, 3-dimethylbutyl, n-octyl, 2-ethylhexyl, 2, 2, 4-trimethylpentyl, 2- octyl, n-decyl, isodecyl, lauryl, tridecyl, myristyl, palmityl, stearyl, isostearyl radical and the like), cycloalkyl of from 6 to 30 carbon atoms (e.g. cyclohexyl radical and the like) or phenyl radical or alkylaryl radical (e.g. p-amylphenyl, p-octylphenyl, p-nonylphenyl, p-dodecylphenyl, p-pentadecylphenyl radical and the like). Here, a and b are real numbers, specifically positive real numbers but not necessarily integers, to hold $a+b=4$. In general formula (X) representing molybdenum dithiocarbamate, $R^{20}$ and $R^{21}$ represent individually a hydrocarbon group with 1-30 carbon atoms, specifically the same as $R^{18}$ and $R^{19}$. Furthermore, a and b are the same as for the aforesaid general formula (IX).

In this invention, the (B) component consists of a single compound or a combination of two or more compounds selected from organomolybdenum compounds represented by the aforesaid general formulas (IX) and (X). The proportion of the (B) component is not limited and can be suitably selected, according to various conditions, to be preferably 0.05-5% by weight and the most preferably 0.1-2% by weight of the whole composition.

In the compositions of this invention, the content ratio of organophosphorus compounds, (A) component, and organomolybdenum compounds, (B) component, is not limited. The weight ratio of (A) component to (B) component is preferably 1:100-100:1, more preferably 1:10-10:1, and the most preferably 1:5-5:1.

In preparing a lubricating oil composition of this invention, either a mixture of aforesaid (A) component and (B) component can be added, or (A) component and (B) component can be separately added to the lubricating base oil.

To this lubricating oil composition, antioxidants, detergent dispersants, rust inhibitors, viscosity index improvers, pour point depressants, extreme pressure agents, oilness agents, antifoamers, and others can be suitably added accordingly as needed. Examples of antioxidants include phenolbased antioxidants, amine-based antioxidants zinc dialkyldithiophosphates. Detergent-dispersants include sulfonate-, phenate-, salicylate-,naphthenate-, or phosphonate-detergents, and alkenylsuccinimide-, or benzylamine-dispersants.

Furthermore, alkenylsuccinates may be available as rust inhibitors; polymethacrylates, polybutenes, ethylene-propylene copolymers, or styrene-butadiene copolymers as viscosity index improvers; polyacrylates and others as pour point depressants; and silicones and others as antifoamers.

Lubricating oil compositions of this invention are excellent in antiwear property, anti-seizure property, and corrosion resistance, and therefore can be effectively used: for gear oils and bearing oils; also for internal combustion engine oils and automatic transmission oils; and further for hydraulic fluids, metal working fluids, and others.

This invention now will be illustrated in more detail by the following examples and comparative examples.

EXAMPLE 1-5 AND COMPARATIVE EXAMPLE 1-5

Lubricating oil compositions were prepared by adding in predetermined proportion (A) organophosphorus compounds (organophosphines), (B) organomolybdenum compounds, and metal deactivators to predetermined mineral base oils.

Then, copper-strip corrosion tests, seizure property tests, and antiwear property tests were carried out on these lubricating oil compositions. The results are shown in Table 1.

Herein, the copper-strip corrosion tests were made according to JIS K 2513 with the conditions of 100° C. and 3 hours; the seizure property tests by Falex test according to ASTM D 3233; and antiwear property tests by Falex test according to ASTM D 2670. The seizure property was evaluated in terms of the seizure load (pound), and the antiwear property was evaluated in terms of the wear amount (mg) of the pin after rubbing under a load of 300 pounds for 60 minutes.

TABLE 1

| | Example | | | | | Comparative Example | | | | |
|---|---|---|---|---|---|---|---|---|---|---|
| | 1 | 2 | 3 | 4 | 5 | 1 | 2 | 3 | 4 | 5 |
| Composition (wt %) | | | | | | | | | | |
| Mineral Base Oil*1 | 98.5 | 98.5 | 98.5 | 98.5 | 99.0 | 99.5 | 99.5 | 99.0 | 98.5 | 98.5 |
| Component (A) | | | | | | | | | | |
| Triphenylophosphine*2 | 1.0 | 1.0 | — | — | 0.5*8 | — | — | — | — | — |
| Tri-n-octylphosphine*3 | — | — | 1.0 | 1.0 | — | — | — | 1.0 | — | — |
| Component (B) | | | | | | | | | | |
| MoDTP*4 | 0.5 | — | 0.5 | — | 0.5 | 0.5 | — | — | 0.5 | — |
| MoDTC*5 | — | 0.5 | — | 0.5 | — | — | 0.5 | — | — | 0.5 |
| Metal Deactivator(1)*6 | — | — | — | — | — | — | — | — | 1.0 | — |
| Metal Deactivator(2)*7 | — | — | — | — | — | — | — | — | — | 1.0 |
| Results | | | | | | | | | | |
| Copper-strip corrosion | 1(1a) | 1(1a) | (1a) | 1(1a) | 1(1a) | 3(3b) | 3(3b) | 1(1a) | 1(1a) | 2(2d) |

TABLE 1-continued

| | Example | | | | | Comparative Example | | | | |
|---|---|---|---|---|---|---|---|---|---|---|
| | 1 | 2 | 3 | 4 | 5 | 1 | 2 | 3 | 4 | 5 |
| Seizure property (lbs) | 1050 | 1140 | 1100 | 1050 | 1050 | 740 | 750 | 510 | 1160 | 720 |
| antiwear property (mg) | 6.0 | 5.7 | 4.8 | 5.0 | 8.2 | 10.5 | 11.4 | 10.8 | 15.1 | 11.2 |

*1hydrogenated mineral oil (150 neutral), produced by Idemitsu Kosan Co., Ltd.
*2PP-360, produced by KI Chemical Industry Co., Ltd.
*3produced by Nippon Chemical Industry Co., Ltd.
*4Molyvan L, produced by R. T. Vanderbilt
*5OD-807, produced by R. T. Vanderbilt
*6AMOCO 150 (thiadiazol), produced by Amoco Chemicals Corp.
*7Reomet 38 (benzotriazol), produced by Ciba-Geigy (UK) Ltd.
*81,2-bis(diphenylphosphino)ethane, sold by Kanto Chemical Co., Inc.

The following are found in Table 1.

(1) In comparative examples 1 and 2, the compositions, not containing organophosphine compounds, are all poor in copper-strip corrosion being rated 3(3b) and show a large amounts of wear in antiwear property tests.

(2) In comparative example 3, the composition, not containing (B) organomolybdenum compounds, shows a large amount of wear in the antiwear property test although is good in copper-plate corrosion with the rate 1(1a).

(3) In comparative example 4, the composition, containing metal deactivators together with (B) organomolybdenum compounds but not containing (A) organophosphine compounds, shows a large amount of wear in the antiwear property test although is good in copper-strip corrosion with the rate 1(1a).

(4) In comparative example 5, the composition, not containing (A) organophosphine compounds, is unsatisfactory in all of the tests for copper-strip corrosion, seizure property, and antiwear property.

EXAMPLES 6-10 AND COMPARATIVE EXAMPLES 6-15

Lubricating oil compositions were prepared by adding various organophosphorus compounds (organophosphite compounds), organomolybdenum compounds, and other components to a predetermined mineral base oil.

Then, copper-strip corrosion tests, seizure property tests, and antiwear property tests were made on these lubricating oil compositions. The results are shown in Table 2.

Herein, the copper-strip corrosion tests were made according to JIS K 2513 with the conditions of 100° C. and 3 hours; the seizure property tests by Falex test according to ASTM D 3233; and antiwear property tests by Falex test acccording to ASTM D 2625. The seizure property was evaluated in terms of seizure load (pound), and the antiwear property was evaluated in terms of the wear amount (mg) of the pin after rubbing under a load of 300 pounds for 60 minutes.

TABLE 2

| | Example | | | | | Comparative Example | | | | | | | | | |
|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 |
| Component (wt %) | | | | | | | | | | | | | | | |
| Mineral Base Oil*1 | 98.5 | 98.5 | 98.5 | 98.5 | 98.5 | 99.5 | 99.5 | 99.0 | 99.0 | 99.0 | 98.5 | 98.5 | 98.5 | 98.5 | 98.5 |
| MoDTP*2 | 0.5 | 0.5 | — | — | — | 0.5 | — | — | — | — | — | — | — | 0.5 | — |
| MoDTC*3 | — | — | 0.5 | 0.5 | 0.5 | — | 0.5 | — | — | — | 0.5 | 0.5 | 0.5 | — | 0.5 |
| Tri(2-ethylhexyl)phosphite*4 | 1.0 | — | 1.0 | — | — | — | — | 1.0 | — | — | — | — | — | — | — |
| Triphenyl phosphite*5 | — | 1.0 | — | 1.0 | — | — | — | — | 1.0 | — | — | — | — | — | — |
| Trilauryl trithiophoshite*6 | — | — | — | — | 1.0 | — | — | — | — | 1.0 | — | — | — | — | — |
| Tricresyl phosphate*7 | — | — | — | — | — | — | — | — | — | — | 1.0 | — | — | — | — |
| 2-ethylhexyl acid phosphate*8 | — | — | — | — | — | — | — | — | — | — | — | 1.0 | — | — | — |
| Dilauryl hydrogen phosphite*9 | — | — | — | — | — | — | — | — | — | — | — | — | 1.0 | — | — |
| Metal Deactivator(I)*10 | — | — | — | — | — | — | — | — | — | — | — | — | — | 1.0 | — |
| Metal Deactivator(II)*11 | — | — | — | — | — | — | — | — | — | — | — | — | — | — | 1.0 |
| Results | | | | | | | | | | | | | | | |
| Copper-strip Corrosion*12 | 1(1a) | 1(1a) | 1(1a) | 1(1a) | 1(1a) | 3(3b) | 3(3b) | 1(1a) | 1(1a) | 1(1a) | 3(3b) | 3(3b) | 3(3b) | 1(1a) | 1(1a) |
| Seizure property (lbs)*13 | 920 | 1120 | 1010 | 1040 | 900 | 740 | 750 | 760 | 890 | 650 | 930 | 910 | 1280 | 1160 | 720 |
| antiwear property (mg)*14 | 7.1 | 3.6 | 7.4 | 4.1 | 5.1 | 10.5 | 11.4 | 12.6 | 10.8 | 40.1 | 9.2 | 8.8 | 3.5 | 15.1 | 11.2 |

*1Hydrogenated mineral oil (150 neutral), produced by Idemitsu Kosan Co., Ltd.
*2Molivan L, produced by R. T. Vanderbilt
*3OD-807, produced by R. T. Vanderbilt
*4JP-308, produced by Johoku Chemical Industry Co.
*5Sumilizer TPP-R produced by Sumitomo Chemical Co., Ltd.
*6JPS-312, produced by Johoku Chemical Industry Co.
*7TCP, produced by Daihachi Chemical Industry Co.
*8Phoslex A-8, Produced by Sakai Chemical Industry Co., Ltd.
*9JP-212, produced by Johoku Chemical Industry Co.
*10AMOCO 150 (thiadiazol), produced by Amoco Chemical Corporation
*11Reomet 38 (benzotriazol), produced by Chiba-Geigy (UK) Ltd.
*12Copper-strip corrosion test: According to JIS K-2513 (100° C. × 3 hrs)
*13Seizure property: According to ASTM D-3233
*14Antiwear property: According to ASTM D-2670

The following and found in Table 2.

(1) In comparative examples 6 and 7, the compositions, containing MoDTP (molybdenum dithiophosphate) or MoDTC (molybdenum dithiocarbamate) but not containing organophosphite compounds, are all poor in copper-strip corrosion with the rate 3(3b), and show much wear in the Falex test.

(2) In comparative examples 8, 9, and 10, the compositions, containing tri(2-ethylhexyl) phosphite, triphenyl phosphite, or trilauryl trithiophosphite, but not containing organomolybdenum compounds, are good in copper-strip corrosion with the rate 1(1a) but are low in seizure load and high in wear amount.

(3) In examples 11, 12 and 13, the compositions, containing tricresyl phosphate, 2- ethylhexyl acid phosphate, or disubstituted phosphite, which have been commonly and widely used, together with MoDTC, are not improved with the copper-strip corrosion being rated 3(3b).

(4) In comparative example 14, the composition, containing a metal deactivator (I) together with MoDTP, is improved with the copper-strip corrosion being rated 1(1a), but shows an increase in wear amount in the Falex test.

(5) In comparative example 15, the composition, containing the most widely used metal deactivator (II) together with MoDTC, shows little improvement with the copper-strip corrosion being rated 2(2d).

(6) In examples 6, 7, 8, 9 and 10, the compositions, containing tri(2-ethylhexyl)phosphite, triphenyl phosphite, or trilauryl trithiophosphite together with MoDTP or MoDTC, are improved with copper-strip corrosion being rated 1(1a), and improved also in seizure load and the decreae of wear amount.

What is claimed is:

1. Lubricating oil composition which comprises: lubricating base oil, (A) at least one organophosphorus compound represented by the general formula (I), (II), (III), (IV), (V), (VI), (VII) or (VIII);

$$R^1R^2R^3P \quad \text{(I)}$$

wherein $R^1$, $R^2$ and $R^3$ are each an alkyl group having 1 to 18 carbon atoms, an aryl group having 6 to 25 carbon atoms or a cycloalkyl group having 6 to 25 carbon atoms, $$R^1R^2PPR^3R^4 \quad \text{(II)}$$

wherein $R^1$, $R^2$ and $R^3$ are the same as defined above, and $R^4$ is an alkyl group having 1 to 18 carbon atoms, an aryl group having 6 to 25 carbon atoms or a cycloalkyl group having 6 to 25 carbon atoms, $$R^1R^2P(CH_2)_nPR^3R^4 \quad \text{(III)}$$

wherein $R^1$, $R^2$, $R^3$ and $R^4$ are the same as defined above, and n in an integer of 1 to 4,

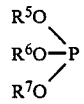

(IV)

wherein $R^5$, $R^6$ and $R^7$ are each a hydrocarbon group having 1 to 30 carbon atoms or a halogenated hydrocarbon group having 1 to 30 carbon atoms,

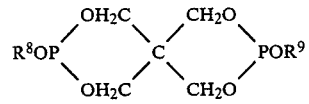

(V)

wherein $R^8$ and $R^9$ are each a hydrocarbon group having 1 to 30 carbon atoms,

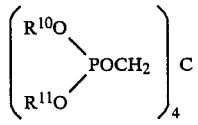

(VI)

wherein $R^{10}$ and $R^{11}$ are each a hydrocarbon group having 1 to 30 carbon atoms,

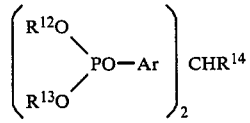

(VII)

wherein $R^{12}$ and $R^{13}$ are each a hydrocarbon group having 1 to 30 carbon atoms, $R^{14}$ is an alkyl group having 1 to 30 carbon atoms and Ar is an arylene group having 6 to 30 carbon atoms,

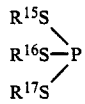

(VIII)

wherein $R^{15}$, $R^{16}$ and $R^{17}$ are each a hydrocarbon group having 1 to 30 carbon atoms, and (B) at least one organomolybdenum compound selected from the group consisting of molybdenum oxysulfide alkylphosphorodithioates and molybdenum oxysulfide alkyldithiocarbamates.

2. The lubricating oil composition as claimed in claim 1 wherein (A) organophosphorus compound is organophosphine compound represented by the general formula (I),(II)or(III).

3. The lubricating oil composition as claimed in claim 1 wherein (A) organophosphorus compound is organophosphite compound represented by the general formula (IV), (V), (VI), (VII) or (VIII).

* * * * *